United States Patent [19]

Yano et al.

[11] Patent Number: 4,696,255

[45] Date of Patent: Sep. 29, 1987

[54] DEVELOPING APPARATUS

[75] Inventors: Hidetoshi Yano, Yokohama; Ryubun Seimiya; Noriyoshi Tarumi, both of Tokyo; Hiromi Demizu, Yokohama; Makoto Obu, Tokyo, all of Japan

[73] Assignee: Ricoh Company, Ltd., Tokyo, Japan

[21] Appl. No.: 761,610

[22] Filed: Aug. 1, 1985

[30] Foreign Application Priority Data

Aug. 7, 1984 [JP] Japan ..... 59-164246
Aug. 8, 1984 [JP] Japan ..... 59-166133
Aug. 9, 1984 [JP] Japan ..... 59-165584

[51] Int. Cl.[4] ..... G03G 15/08
[52] U.S. Cl. ..... 118/653; 355/3 DD
[58] Field of Search ..... 118/653; 355/3 DD

[56] References Cited

U.S. PATENT DOCUMENTS 4,282,303 8/1981 Bergen ..... 118/653

*Primary Examiner*—Bernard D. Pianalto
*Attorney, Agent, or Firm*—Cooper, Dunham, Griffin & Moran

[57] ABSTRACT

In a developing apparatus for a copying machine in which a latent image on a latent image carrying member is developed by supplying a thin layer of a developer to the latent image carrying member, an electrically insulating layer having a number of electrically conduction spots dispersed therein is provided on a developer carrier member for supplying a developer from a developer storage to a latent image carrying member.

16 Claims, 7 Drawing Figures

DEVELOPING APPARATUS

BACKGROUND OF THE INVENTION

The present invention relates to a developing apparatus using a monocomponent developer and, particularly, to such apparatus using a non-magnetic monocomponent developer.

The conventional developing method of dry tape which is utilized for electrophotography or electrostatic recording, etc., is classified generally into two approaches, one using a bicomponent (dual component) developer containing toner and carrier and the other using monocomponent type developer containing no carrier. The former method can provide a relatively stable, good copy image. However, there are disadvantages of degradation of carrier, variation of mixing ratio of toner to carrier, maintenance difficulties of the copying machine and difficulties in minimizing the size of machine.

In view of this, the monocomponent type developer is desirable. The conventional monocomponent type developer is usually a toner containing some material corresponding to carrier and, when the toner is moved magnetically, the material is a magnetic material. However, since such magnetic material is usually opaque, its pigment is a disadvantage in a color development, and makes it difficult to obtain a sharp color image. Therefore, the developer for color development should not contain magnetic material. In such case, however, one problem how to move the developer smoothly along a predetermned direction. In addition, the known monocomponent type developer is generally not suitable to develop an image based on a low contrast original image or characters written by using hard pencils, etc. That is, the known monocomponent developer is not suitable to develop an area image or a line image whose concentration is selectively changed.

SUMMARY OF THE INVENTION

The present invention was made in view of the above mentioned state of art and an object of the present invention is to provide a developing apparatus in which it is possible to obtain stably a high image quality even when a non-magnetic monocomponent type developer is used and which is also applicable to color developing.

The above object can be achieved, according to the present invention, by a provision of an electrically insulating layer having a number of electrically conductive spots dispersed therein on a developer carrier member for supplying a developer from a developer storage to a latent image carrying member.

With the provision of such insulating layer on the developer carrier member, it is possible to smoothly feed a developer such as non-magnetic toner which can not be moved smoothly with some external magnetic means and thus to obtain a satisfactory area image-line image developing characteristics. That is, it is possible to form a thin uniform membrane (or film) of toner having the required amount of charge on the developer carrier member and thus to ensure the high image quality for a long period of time, even if the toner is of monocomponent type non-magnetic material.

According to the present invention it is possible to provide a sharp edge effect in an imaging process and thus to reproduce both a line image and an area image to the required extents, respectively, even when a monocomponent developer having no carrier is used. This is due to the existence of the minute conductive electrodes dispersed in the insulating layer which are electrically floating. Metal particles are usually used as minute conductive electrodes. When some of the metal particles are exposed on the insulating layer, the amount of developer to be carried on the developer carrier member and transported to a developing region in the apparatus might be reduced below that required to obtain a good copy, resulting in a degraded copy image.

In order to avoid this problem, in the present invention, each of the minute electrodes to be dispersed in the insulating layer is formed from a particle dispersing conductive material in a plastic binder.

DESCRIPTION OF THE PREFERRED EMBODIMENTS

Figure 1:
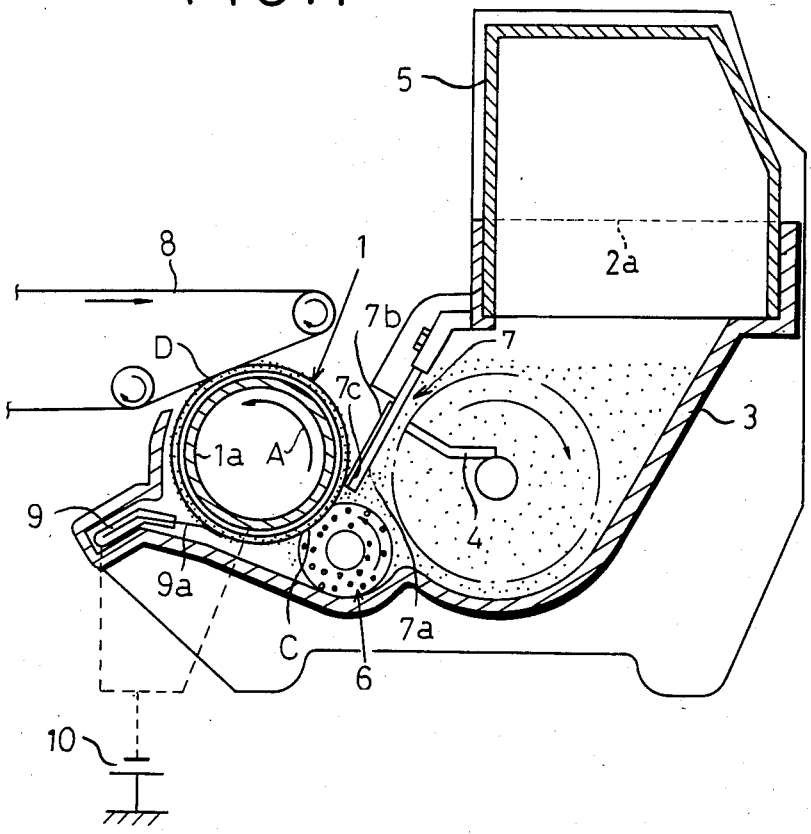
FIG. 1 is a cross sectional view of an embodiment of a developing apparatus according to the present invention where a non-magnetic monocomponent type developer is used.

In FIG. 1, a developer carrier member or developing sleeve 1 is supported rotatably and driven in a direction shown by an arrow A at a predetermined rotational speed. The sleeve 1 is composed of a cylindrical substrate 1*a* of a conductive material such as aluminum, an insulating layer 1*b* of an insulating material such as chloroprene resin formed on the substrate 1*a* and an electrode layer 1*c* formed on the insulating layer 1*b*. The electrode layer 1*c* is of an insulating material in which a number of electrode particles 2 are uniformly dispersed so that the particles are electrically isolated from each other and from the conductive substrate 1*a*. For example, the electrode layer 1*c* may be formed by uniformly mixing an insulating material such as epoxy resin with a conductive material such as graphite to obtain the insulating material containing graphite uniformly dispersed therein and painting the insulating layer 1*b* with the resultant insulating material. Particles of metal such as copper may be used instead of graphite. As the insulating material to be mixed with the conductive material, any of a variety of materials such as those belonging to aclyl group, uretane group, stylene group, aclyl-uretane group, epoxy-silicon group or epoxy-fluoride group may be used, provided that a selected material is in a different position in triboelectric series from that of the toner, to ensure an effective triboelectrification of the toner.

Figure 3:
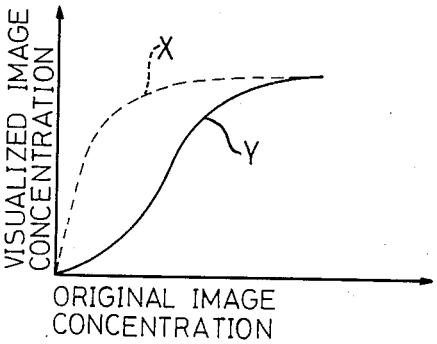
FIG. 3 is a graph for explaining the effect of minute electrodes dispersed in a developer carrier member of the present apparatus.

With the use of the sleeve having such minute electrodes 2, it is possible to obtain and effective edge effect in (developing) a latent image even when the toner is of the monocomponent type and thus improve the developing efficiency of the latent image. FIG. 3 is a graph showing a relation of image concentration of an original sheet to be copied to a concentration of a visualized image. It may be usual for an operator of the coping apparatus that he wishes to have a high concentration visual image of a pattern such as a character composed of thin lines even if a concentration of those lines on an original sheet is low, as shown by a dotted curve X in FIG. 3 while he wishes to have a visual image having an area whose concentration corresponds substantially to that of a corresponding area image on the original sheet, as shown by a solid curve Y in FIG. 3. The copying apparatus using the minute electrodes makes formatios of visual images meeting with or corresponding to these requirements possible.

The adhesion of toner to an insulating layer such as epoxy resin containing particles of low resistance material such as graphite dispersed therein as the minute electrodes, is better than that to a metal. Therefore, it becomes possible to carry a required amount of toner even of non-magnetic material without any influence of specific force such as magnetic force. The conductive substrate 1*a* is connected to a biasing source 10 and biased thereby at the same potential as that applied to a charge removing brush 9 to be described later.

A hopper 3 is provided to store the developer, a lower end portion of which is opened to the developing sleeve 1. The hopper 3 has an upper portion in which a toner supply hole 2*a* is formed and on which a cartridge 5 filled with toner is mounted so that toner in the cartridge 5 goes down through the hole 2*a* into the hopper 3 by gravity. An agitator 4 is rotatably disposed in the hopper 3 for feeding toner therein toward a surface of the sleeve 1 while preventing a condensation of toner.

Around the opening of the lower end portion of the hopper 3, a toner supply member 6 for enhancing the movement of toner toward the sleeve 1 is rotatably disposed. It is preferrable to dispose the toner supply member 6 in pressure contact with the surface of the sleeve 1 and rotate it in the same direction as a rotating direction of the sleeve 1 as shown by an arrow. That is, in a contact portion C, the surface portions of the sleeve 1 and the toner supply member 6 are in contact with each other while moving in opposite directions to each other. With this construction, toner is pinched in between the sleeve 1 and the supply member 6 and effectively charged frictionally, with the thickness of the toner layer being regulated, so that a toner layer having a uniform thickness is formed on the sleeve 1. In this case, it may be possible to obtain the same effect by disposing the supply member 6 with a space between it and the sleeve 1 and by using toner having a better triboelectrification efficiency and/or providing a separate pressure member. The optimum peripheral speed of the toner supply member 6 depends on the peripheral speed of the developing sleeve 1. It is usual, however, to set the peripheral speed of the toner supply member 6 higher than that of the sleeve 1 so that it moves in slipping contact with the sleeve 1. When the speed of the member 6 is too high, there may be an increased scattering of toner, increased condensations thereof on a bearing portion of the sleeve and/or on walls of the hopper 3. Therefore, it should be set in an adequate range.

In order to perform triboelectrification of toner with high efficiency, the material forming a surface portion of the toner supply member 6 should have its position in the triboelectrification series remote from that of the toner. In this embodiment, the toner supply member 6 includeds a surface layer of a flexible material such as polyuretane foam whose foaming degree is preferably in the range from 10 to 100 cells to provide a suitable sponge surface. The developing sleeve 1 of 25.4 mm diameter is rotated at 400 rpm and the toner supply member 6 of 14 mm diameter is rotated at 800 rpm, the peripheral speed ratio being set about 10:11. In order to supply an optimum amount of toner to the contact portion C continuously, to thereby form a desired toner layer on the surface of the developing sleeve 1, the hardness of the flexible surface layer of the supply member 6 should be high enough and the diameter of cell thereof should be small enough.

With the provision of such a toner supply member, the toner stored in the hopper 3 and fed out with the rotation of the agitator 4, is moved with the rotation of the toner supply member 6 and transported smoothly to the contact portion C. In the contact portion C, the toner is pinched between the member 6 and the sleeve 1 and frictionally charged. Then it adheres to the surface of the sleeve 1. In this case, the toner is forced to follow the rotation of the supply member 6 by mainly electrostatic force produced by friction between the supply member and the toner. Therefore, the toner is transported smoothly from the hopper 3 to the surface of the sleeve 1 even if the toner does not contain a carrier or magnetic material. Alternatively, a fur brush, a metal or plastic roller, etc., may be used instead of the flexible roller.

A doctor blade 7 is disposed downstream of the toner supply member 6 in the rotational direction of the developing sleeve 1. The doctor blade 7 functions to restrict the thickness of the toner layer formed on the surface of the sleeve 1 to a suitable value. The doctor blade 7, in this embodiment, is composed of a base member 7*a* of a resilient material and an insulating membrane (or film) 7*b* of fluoride resin such as tetrafluoroethylene-perfluoroalkyl vinyl ether copolymer formed on one surface of the base member 7*a*. A free end portion 7*c* of the doctor blade 7 is in pressure contact through the insulating membrane 7*b* thereof with the surface of the sleeve 1 to thereby restrict the thickness of the toner layer thereon. In this case, the doctor blade 7 may be oriented to trail on the surface of the sleeve 1 although it is oriented oppositely in FIG. 1. In either case, the free end portion 7*c* is kept in contact with the surface of the sleeve 1. With this construction it is possible to make the thickness of the toner layer uniform reliably over substantially the entire desired width of the sleeve 1 and thus to form a uniform and thin toner layer stably. The insulating membrane 7*b* of the doctor blade 7 functions to prevent condensation of toner on the sleeve surface and to improve the electrification characteristics thereof. This is enhanced further by the usage of a fluoride material for the insulating membrane.

As other materials for the insulating membrane 7*b*, those from which toner is easily separable are preferrable. For example, any high molecular fluoride such as polytetrafluoroethylene (TFE), tetrafluoroethylene-hexafluoropropylene copolymer (FEP), tetrafluoroethylene-ethylene copolymer (ETFE) or polychlorotrifluoroethylene (CTFE), material containing such high mlecular fluoride, polyethylene, polypropyrene and silicon resin may be used for this purpose. It may be possible to add an additive such as graphite, carbon fiber, glass fiber, fine powder of silica or fine powder of SiC to such material to improve the abrasion resistance characteristics of the insulating membrance 7*b*.

An endless belt 8 is disposed in a suitable place downstream of the doctor blade 7 so that a portion of the endless belt 8 is in contact with the surface of the sleeve 1. The endless belt 8 is of an organic photosensitive material or carries a latent image carrier sheet of an organic photosensitive material, the latent image thereon being developed in a developing region D defined around a contact portion between the sleeve surface and the portion of the endless belt 8.

An electrostatic latent image formed on a surface of the photosensitive endless belt 8 through the steps of uniform charging of the belt and image exposure is carried to the developing region D with a rotational movement of the endless belt. At the same time, the toner layer whose thickness is uniformly thin and which is charged enough for developing the electrostatic latent image by triboelectrification, is also carried to the region D with rotation of the sleeve 1. In this case, since the electrode layer 1*c* of the sleeve 1 is formed of insulating material such as epoxy resin to which toner is easily attracted, it can carry the developer uniformly thereon even if the developer itself has no special attractive force to the sleeve surface, and thus the non-magnetic, monocomponent type toner can be used. Therefore, the tin and uniformly charged toner layer is fed stably to the electrostatic latent image formed on the endless belt 8 in the developing region D and thus the latent image is visualized thereby.

A charge removing brush 9 is disposed downstream of the developing region D to remove unnecessary charges accumulated on the surface of the sleeve 1. That is, there is a tendency of accumulation of charge of undesired polarity on the surface of the sleeve 1 due to friction between it and the supply member 6, the doctor blade 7 and the photosensitive belt 8. Since such charge is one of sources of image defects, it is necessary to remove it completely. Particularly, charges accumulated on an insulative material, such as epoxy resin, forming the electrode layer 1*c* of the developing sleeve 1, are relatively difficult to remove compared with a metal material. Therefore, a charge removing means capable of removing such charges from insulative material effectively, is highly desired. In view of such need, a charge removing brush 9 is designed, in material, size and mounting, so that the free ends of conductive brush hairs 9*a* of a resilient material abut resiliently against the surface of the sleeve 1 uniformly with a suitable pressure. Therefore, the brush hairs 9*a* can uniformly contact with the surface to cover a desired widthwise area thereof and thus a uniform charge removal can be achieved. The brush 9 is connected to the biasing source 10 and biased to the same potential as that of the conductive substrate 1*c* of the sleeve 1. With this arrangement, undesirably accumulated charges as well as charges of non-used, residual toner on the sleeve 1 can be selectively removed effectively.

The toner whose charges are removed in this way is transported with rotation of the sleeve 1 to a region in which the roller 6 is disposed and scraped out easily. That is, the roller 6 is deformed by the pressure contact with the sleeve 1, providing a considerably large surface contact area, so that, upstream of the contact region C with respect to the rotating direction of the sleeve, toner carried by the roller 6 is forced to adhere to the surface of the sleeve 1 while, in the downstream side, the roller 6 functions to scrape away residual toner on the surface. Toner scraped is returned to the hopper 2 with rotation of the roller 6 for reuse.

Although, in this embodiment, toner is of non-magnetic monocomponent type, this invention is also applicable for a developing apparatus using othr toners including magnetic toner. In the latter case, a magnet is provided in the sleeve 1 fixedly or rotatably. At least one of the magnet and the sleeve 1 is rotated to carry toner. It may be possible to provide a magnet such as of magnetic rubber or plastic, which has a number of poles, integrally with the sleeve and to rotate the latter.

This sleeve construction can be used for non-magnetic toner, with the doctor blade 7 being made of magnetic material so that it is attracted by the magnet of the sleeve to pressure contact therewith uniformly. Further, this invention is also applicable to a system in which a drum type latent image carrier such as photosenstive rigid drum is used. It is also possible to make the magnetic doctor blade resilient so that the contact pressure to the sleeve 1 is made optimum.

Figure 4:
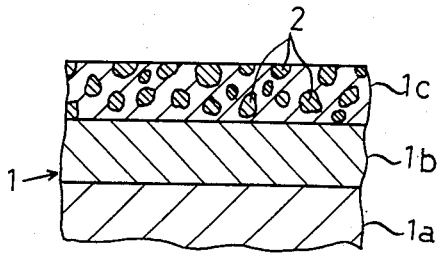
FIG. 4 is an enlarged view of a portion of another developing sleeve according to another embodiment of the present invention.
Figure 5:
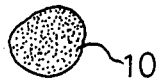
FIG. 5 shows a sectional view of one of the minute electrodes in an enlarged scale.

In order to increase the effect of the minute electrodes 2, it is advisable to expose at least a portion of the electrodes on the surface of the sleeve 1 as shown in FIG. 4, as mentioned previously. As also mentioned previously, however, when the electrodes 2 are particles of a metal such as copper, the amount of toner to be carried by the sleeve 1 may be reduced to an extent that image quality in degraded. In order to resolve this problem, the particle electrode of the present invention is prepared by dispersing conductive particles of materials such as graphite or metal, etc., in an insulating resin such as epoxy resin and pulverizing it into particles having diameter in a range from 60$\mu$ to 150$\mu$, as shown in FIG. 5. Such particles are conductive as a whole and form the particle electrode 2 when dispersed in the insulating material of the layer 1*c* without reduction of the amount of toner thereon even if some of them are exposed. The quantity of particle electrode 2 to be added can be of wide limit, for example, 10–1000 parts by weight, preferably 20–800 parts by weight, of particle electrode can be added to 100 parts by weight of insulating resin.

The reason why such reduction of the amount of toner is prevented by such particle is not always completely clear. However, the toner of a resin may adhere not to a metal portion but to a resin portion of the minute electrodes 2 exposed on the sleeve surface.

As resin material for the minute electrode 2 other than epoxy resin, any of the resins of sthylene group, silicon group, polyamide polyestel, fluoride resin, aclyl resin and uretane resin, may be used. As the insulative layer 11, any of silicon resins, aclyl resins, uretane resins, aclyl-uretane resins, epoxy-silicon resins, polyester polyamide, fluoride resins and epoxy-fluoride resins can be used, provided that the position of it in the triboelectrification series is remote from that of the resin forming the toner so that the charging condition of the latter is stable on the sleeve 1 and is not influenced adversely by the presence of the doctor blade 7.

The developing sleeve layer 1*c* shown in FIG. 4 may be manufactured by pulverizing an insulative resin such as epoxy resin, in which graphite or metal particles etc. are dispersed, to form particles such as shown in FIG. 5, dispersing the latter particles uniformly in a resin, painting the latter on the insulating layer 1*b* laminated on the conductive layer 1*a* forming a core member of the sleeve and, after the paint is hardened, polishing an outer surface of the painted layer. Alternatively, it may be be possible to form it by painting the resin on the conductive layer 1*a* or the insulative layer 1*b*, spraying the particles thereon uniformly and polishing the outer surface thereof after fixed.

It may be also possible to form an overcoat layer of insulative material on the electrode layer 1c. This may be effective to prevent a dropping out of the electrode particles 2 and a direct contact of toner to the metal portion of the electrode particles. However, in order to avoid a fading out of the effect of the minute electrodes, the thickness of such overcoat layer should be as thin as possible.

Figure 2:
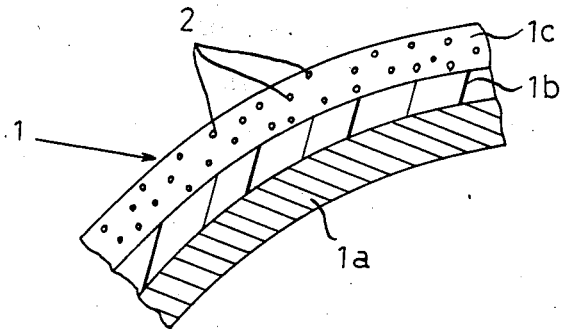
FIG. 2 is an enlarged view of a portion of a developing sleeve of the apparatus showon in FIG. 1.
Figure 6:
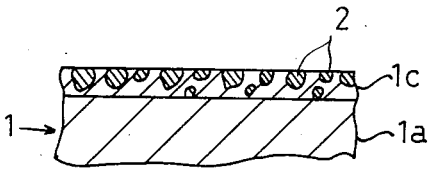
FIG. 6 shows a developing sleeve according to a further embodiment of the present invention.

The insulative layer 1b shown in FIGS. 2 and 4 functions to regulate the dielectric thickness measured from the conductive layer 1a to the photosensitive member 8 (FIG. 1), to thereby regulate the intensity of the electric field formed therebetween. Therefore, the layer 1b may be omitted, if necessary, as shown in FIG. 6.

Figure 7:
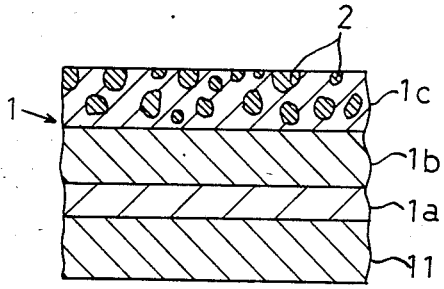
FIG. 7 shows a developing sleeve according to a still further embodiment of the present invention.

Also, in this embodiment, instead of using the conductive layer 1a is used as the core member of the sleeve 1, it is possible to provide a cylindrical core member 11 and form the conductive layer 1a thereon, as shown in FIG. 7. Although the sleeve 1 is made rigid as a whole in this embodiment, it may be possible to constitute at least a portion thereof, for example, at least one of the respective layers shown in FIGS. 2, 4, 6 and 7, and the overcoat layer with a resilient material so that the sleeve 1 comes in a smooth contact with the photosensitive member 8 to prevent any damage of the latter. For example, the electrode layer 1c may be formed of a elastic epoxy resin or the insulative layer 1b is formed of chloroprene rubber, a foamed resin, sponge or elastic resin etc. Alternatively or additionally, the core member 11 in FIG. 7 may be formed of rigid core material or metal, plastic or the like and elastic rubber, foamed material or elastic epoxy resin formed on the rigid core material.

When the core member 11 is formed of paper, the cost and weight thereof can be reduced remarkably. With such remarkably reduced cost of the sleeve, it is possible without substantial economical loss, to make the latter disposable.

It is usual to use the developing sleeve 1 as an electrode facing the photosensitive member 8 by applying a biasing voltage thereto from the power source 10 as shown in FIG. 1. In this case, at least a portion of the sleeve 1 should be conductive. When the core 11 is made from the paper cylinder, the biasing voltage is applied to the conductive layer 1a. The conductive layer 1a may be formed by adhering a thin conductive sheet such as aluminum foil to a surface of the paper cylinder 11 or coating the latter with a conductive resin since the conductive layer 1a is not required to have a mechanical strength. This fact may attribute to a further reduction of the weight as well as the cost of the developing sleeve 1.

What is claimed is:

1. A developing apparatus for supplying a thin layer of a developer to a latent image carrying member of a copying machine to develop a latent image on said latent image carrying member, comprising a storage means for storing said developer, a developer supply member rotatably supported for supplying said developer to said latent image carrying member, said developer supply member having a surface portion composed of an electrically insulative layer having minute, electrically floating, conductive regions dispersed therein, a developer feeding member disposed rotatably between said storage means and said developer supply means and being in contact with said developer supply means for feeding said developer from said storage means to said developer supply means, and a layer thickness regulating member having a portion in pressure contact with said surface portion of said developer supply member for regulating the thickness of said thin layer of said developer on said developer supply member.

2. The developing apparatus as claimed in claim 1, wherein said layer thickness regulating member comprises a main portion of a resilient material and an insulative layer provided on at least a side surface of said main portion, said side surface being in pressure contact with said surface portion of said developer supply member.

3. The developing apparatus as claimed in claim 2, wherein said developer feeding member is rotated in the same direction as said developer supply means.

4. The developing apparatus as claimed in claim 1, wherein said developer feeding member is rotated in the same direction as said developer supply means.

5. The developing apparatus as claimed in claim 1, further comprising a charge removing means for removing undesired charges from said developer supply member.

6. The developing apparatus as claimed in claim 1, wherein each of said minute conductive regions dispersed in said insulative layer of said developer supply member comprises a resin material containing conductive material dispersed therein.

7. The developing apparatus as claimed in claim 6, wherein said minute conductive regions are exposed on said surface of said developer supply means.

8. The developing apparatus as claimed in claim 6, wherein said developer supply means is a rotary cylinder comprising a conductive layer, an insulative layer formed on said conductive layer and said electrically insulative surface layer formed on said insulative layer.

9. The developing apparatus as claimed in claim 8, wherein said conductive layer is formed on a core cylinder of paper.

10. A developing apparatus for supplying developer to a latent image on a latent image carrier, comprising:

a developer supply member comprising a layer of a first electrically insulating material having minute electrically conductive regions dispersed therein, said conductive regions being electrically floating;

means for forming a film of developer on said layer, said film having a regulated thickness; and means for applying the film to said latent image to develop it.

11. A developing apparatus as in claim 10 in which said conductive regions comprise minute, electrically conductive electrodes, wherein each electrode comprise fine particles of an electrically conductive material dispersed in a second electrically insulating material, said electrodes being dispersed in said first electrically insulating material, wherein said first and second insulating materials may be the same or different.

12. A developing apparatus as in claim 11 in which at least some of said electrodes are exposed to and can make at least partial contact with said film of developer.

13. A developing apparatus as in claim 10 in which said developer supply member comprises a cylinder having said layer on its peripheral surface.

14. A developing apparatus as in claim 13 in which the cylinder includes a core member which is made of paper and is the primary mechanical support for said layer.

15. A developing apparatus as in claim 14 including a layer of conductive material formed between the paper core and the insulating layer, and means for keeping the conductive material layer at a selected bias potential.

16. A developing apparatus as in claim 13 in which the cylinder comprises means for causing the electrically insulating layer to flex and give when contacting said latent image carrier.

* * * * *